United States Patent [19]

Okolischan et al.

[11] Patent Number: 4,832,325

[45] Date of Patent: May 23, 1989

[54] SPRING STOP ADAPTOR FOR MODULAR FIXTURING

[75] Inventors: Raymond A. Okolischan, St. Louis County; William C. Wood; Theodore R. Metz, both of Saint Louis, all of Mo.

[73] Assignee: Carr Lane Mfg. Co., St. Louis, Mo.

[21] Appl. No.: 152,805

[22] Filed: Feb. 5, 1988

[51] Int. Cl.[4] ..... B25B 1/08

[52] U.S. Cl. ..... 269/305; 269/317

[58] Field of Search ..... 269/254 R, 254 CS, 303, 269/305, 315, 316, 317, 297, 299, 900

[56] References Cited

U.S. PATENT DOCUMENTS 4,157,819 6/1979 Meyer ..... 269/900

FOREIGN PATENT DOCUMENTS 638446 12/1978 U.S.S.R. ..... 269/303

2124129 2/1984 United Kingdom ..... 269/317

OTHER PUBLICATIONS

"Modular Fixturing" by Edward G. Hoffman, Manufacturing Technology Press 1987.

*Primary Examiner*—Robert C. Watson

*Attorney, Agent, or Firm*—Jerome A. Gross

[57] ABSTRACT

An adjustable adapter, expecially useful for modular fixturing has provisions for mounting a variety of types and sizes of spring stop buttons and spring locating pins. These are secured in linear alignment with a slot in the adaptor base. When used to press a workpiece against stops, the reaction of their applied spring force is directed precisely along the line of this base slot. A single bolt in the slot thus suffices to secure the adaptor to a base plate, because this reaction causes no twisting moment about the point of bolting. Since only one bolt is required in the slot, the adaptor is compact and well suited for use with a modular fixturing plate; the slot length need be no longer than half the modular spacing of the plate bores.

6 Claims, 1 Drawing Sheet

SPRING STOP ADAPTOR FOR MODULAR FIXTURING

FIELD OF THE INVENTION

The present invention relates to modular fixtures for holding workpieces, such as rough castings, during machining operations; specifically it provides an adaptor usable with a modular mounting plate, for mounting a variety of types and sizes of spring stops.

DESCRIPTION OF THE RELATED ART

Workpieces produced by such processes as casting and forging are conventionally machined after securement by a fixture specially made to hold the particular style of workpiece. One type of such specially made fixture uses spring-biased stop buttons or pins to exert spring pressure against an edge of the workpiece.

To avoid creating special fixtures for each type and size of workpiece, some work has been done in the field of modular fixturing, that is, building special-purpose fixtures out of standard parts assembled on a modular fixturing plate. To the best of applicant's knowledge, no one has heretofore created standard adaptors, to be adjustably positioned on such modular plates, upon which to mount a variety of types and sizes of spring stop pins or buttons.

SUMMARY OF THE INVENTION

In the present invention, an adaptor is provided to be slidably adjustable along a modular fixturing plate and securable thereto with only a single bolt. The adaptor accommodates one of several sizes of a standard type of either spring buttons or spring locating pins. The reaction of the spring force exerted by them causes no twisting moment about the securing bolt.

DESCRIPTION OF THE PREFERRED EMBODIMENT

Figure 1:
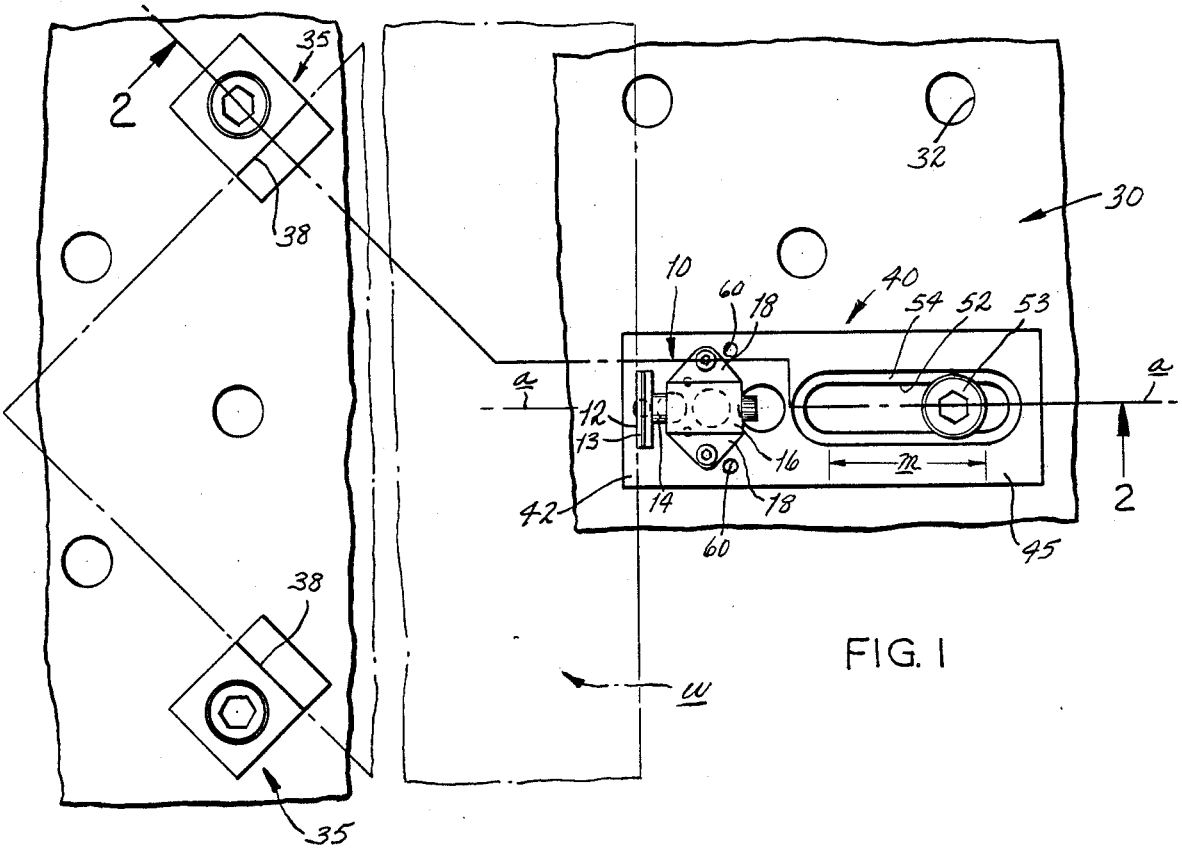
FIG. 1 is a plan view showing the adaptor of the present invention at right, with a spring stop button of conventional type mounted thereon. Supporting the adaptor is a modular fixturing plate, on which are mounted, at left, a pair of conventional support stop blocks, against which a spring stop button is pressing a workpiece shown in phantom lines.
Figure 2:
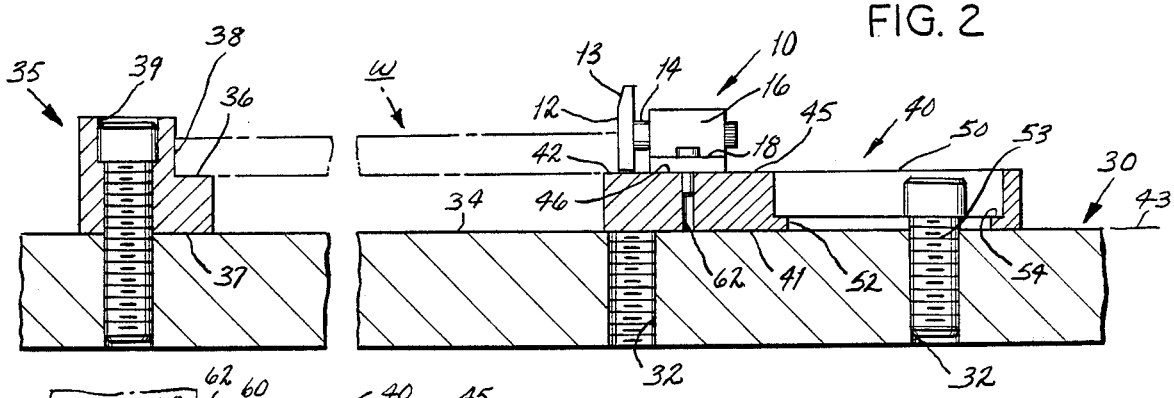
FIG. 2 is a vertical sectional view thereof taken along the broken line 2—2 of FIG. 1.
Figure 3:
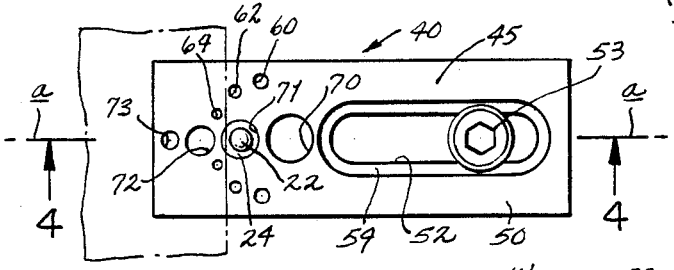
FIG. 3 is a plan view corresponding to the right hand portion of FIG. 1, but with a spring stop locating pin mounted instead of a spring stop button.

The adjustable adaptor of the present invention is illustrated in the drawings in connection with conventional spring stop accessories, in this case a spring stop button generally designated 10 shown in FIGS. 1 and 2, or alternatively a spring stop pin 20 shown in FIG. 3. The spring stop button 10 includes a pressure pad 12 whose upper edge 13 is preferably tapered downward and forward. The pad 12 is mounted on a shaft 14 which is spring biased in a casing 16 having mounting lugs 18 spaced evenly on opposite sides of the shaft. The spring stop pin generally designated 20 and shown in FIG. 3, comprises a locating pin 22 resiliently and tiltably mounted in a lower cylindrical case 24, which contains a coil spring to bias the pin 22 toward upright position.

In order to mount such a spring stop button 10 or pin 20 for adjustable positioning, there is provided a modular fixturing plate generally designated 30 having a plurality of preferably threaded bores 32 at equally spaced or modular intervals. The fixturing plate 30 has a smooth planar upper surface 34.

Other conventional elements useful with the present invention are stepped support blocks generally designated 35. A shown in FIG. 2 each is stepped up, having a horizontal support surface 36 at a chosen distance above its under surface 37, terminating in a vertical abutment face 38. Using a vertical bore 39, the support block 35 is bolted to one of the bores 32 of the fixturing plate 30. Two such support blocks 35 are illustrated in FIG. 1; on their support surfaces 36 and against their abutment surfaces 38 of each is presented an edge of a workpiece generally designated w, here shown to be of somewhat triangular form.

The third workpiece edge, as shown in FIGS. 1 and 2, rests on the forward surface portion 42 (herein referred to as the work support portion) of the adjustable adaptor, generally designated 40, which embodies the present invention. The adaptor 40 is a block-like body of any desired thickness, having an elongated base 41 whose under surface 43 defines a plane. The work support portion 42 is the forward portion of the upper surface 45; aft of it is an intermediate or stop-mounting portion 46, followed by an aft portion 50, to be described.

The aft portion 50 of the adaptor 40 has a vertical linear slot 52 extending along a linear axis of symmetry a—a. The slot is of such width as to accommodate the shank of a headed bolt 53; since its head is to bear downward, the upper portion of the slot 52 is enlarged to provide a step 54, which is overlapped by the bolt head. The slot 52 has ends rounded about centers; the distance between such centers is hereby referred to as the effective slot length m, or merely as the slot length.

The adaptor 40 is bolted by a single bolt 53 to the fixturing plate 30 at any of its bores 32 and positioned slidably to extend forward from the bolt 53 as much as one effective slot length m, or to extend aft from the bolt as much as one such slot length.

To support a spring stop button such as the button 10 of FIGS. 1 and 2, of a desired size, a plurality of bores 60, 62, 64, best seen in FIG. 3, are provided in pairs spaced symmetrically on opposite sides of the axis a—a. The bores 60 seen in FIGS. 1 and 3 are at a wider spacing than the bores 62 and accept a larger spring stop button than the button 10 of FIGS. 1 and 2; the spaced-apart lugs 18 of that button 10 fit the bores 62 and are shown mounted onto them by machine screws; whereas a still smaller pair of symmetrical bores 64 to accommodate a smaller spring stop button is best seen in FIG. 3.

Figure 4:
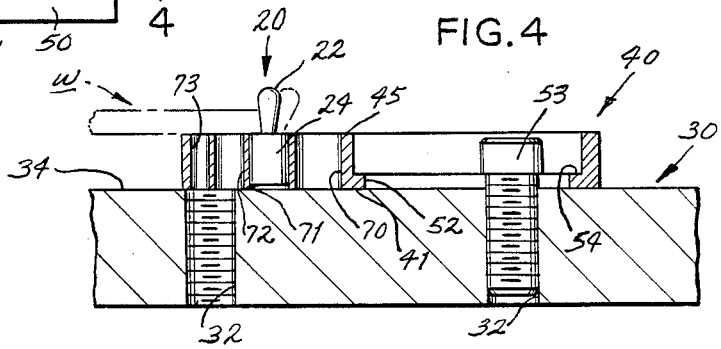
FIG. 4 is a cross-sectional view taken along line 4—4 of FIG. 3.

Referring now to FIG. 4, the forward portion 42 of the adaptor body has four aligned vertical cylindrical wells 70, 71, 72, 73, each of a different diameter. In the well 71 is shown a standard locating pin 20 whose cylindrical case 24 is of such diameter as to substantially fill the cylindrical well 71. The other wells 70, 72, 73 are of such diameter as to a accommodate other standard sized spring locating pins 20.

In use, a workpiece w is the first of a series of similar plates to be machined; it is shown schematically as a simple triangular plate. It is first rested on the support surfaces 36 of the support blocks 35; then, using its third edge, the spring stop button 10 (or a spring locating pin 22, if used) is pressed against the workpiece edge; the adaptor axis a-a is set perpendicular thereto; and the bolt 53 is tightened in the bore 32.

After machining the first workpiece w of the series to be machined, it is pried out by forcing the spring stop button 10 or pin 20 backward. Then, each subsequent workpiece of the series is merely snapped in place for machining. As seen in the phantom line showing of FIG. 4, the spring stop pin 22 will tilt aft to permit the insertion and removal of the workpieces. Where a stop button 10 is used, the slope of its upper forward edge 13 facilitates insertion of the workpieces.

Inasmuch as either the spring stop button 10 or the stop pin 20 is mounted symmetrically with regard to or on the axis a—a, the reaction of the spring force is exerted precisely along this axis; no twisting moment develops about the mounting of the adaptor 30. The adaptor 40 may be slid forward to extend from its mounting bolt 53 as much as one full effective length m of the slot 52, and there secured to the fixturing plate 30; or it may be slid aft from the bolt the same distance, and there secured; or it may be secured at any intermediate point. Therefore, a single bolt 53 suffices for its mounting. As a consequence of this freedom from twisting moment from the reaction of the spring force, the effective length m of the slot 52 need be only half as great as the modular spacing between the bores 32 in the base plate 30.

From this disclosure, modifications of the invention, departing from the foregoing described embodiment, will be apparent. It is therefore to be understood that within the scope of the appended claims, the invention may be practiced otherwise than as here specifically described.

We claim:

1. An adjustable adaptor for mounting a spring stop onto a fixturing plate, comprising an elongated base having an undersurface defining a plane and having a forward portion and an aft portion formed-relative to a longitudinal rectilinear axis, a slot in its aft portion extending along said axis perpendicular to and through said undersurface, the forward portion having a forward end and, spacedly aft therefrom, a plurality of means for so mounting such a spring stop as to exert its spring force forwardly, each of said plurality of means for mounting being centered on said axis, said forward portion having, between its said forward end and said plurality of mounting means, a workpiece-support portion defining a plane substantially parallel to the plane of said undersurface, whereby on mounting a forwardly-directed spring stop on one of said plurality of mounting means and directing the spring force of such stop against a workpiece positioned on said workpiece support portion, the reaction of said spring force is directed along the said rectilinear axis and exerts no twisting force about a single bolt through said slot securing said adaptor to such fixturing plate.

2. An adjustable adaptor for mounting a spring stop as defined in claim 1, in combination with spring stop means mounted in one of said plurality of means for mounting.

3. The combination defined in claim 2 wherein the plurality of means for mounting comprises a plurality of pairs of threaded bores, each bore of each said pairs being spaced opposite symmetrically to the other bore of the same pair, the spacing of each of said pairs from said axis being different from the spacing of any other said pairs of bores, and in which said spring stop means comprises a pressure pad mounted on a shaft spring-biased axially in a casing having mounting lugs spaced evenly on opposite sides of said shaft axis at a distance corresponding to the spacing of one of said pairs of threaded bores, whereby on mounting said spring stop means onto one of said pairs of threaded bores, the axis of its shaft will coincide with the longitudinal rectilinear axis of the adaptor base.

4. The combination defined in claim 2 wherein said plurality of means for mounting comprises a plurality of vertical cylindrical wells of different sizes, each well being centered on said axis, and in which said spring stop means comprises a tiltable, normally upright, locating pin resiliently mounted in a lower cylindrical case whose diameter substantially equals that of one of said cylindrical wells, said locating pin being spring-biased toward upright position.

5. The combination defined in claim 2, in further combination with a base plate having a planar upper surface and a plurality of bores into said surface at a modular spacing no greater than twice the effective length of said slot.

6. An adjustable adaptor for mounting a spring stop onto a fixturing plate, comprising an elongated base having an undersurface defining a plane and having a forward portion and an aft portion formed relative to a longitudinal rectilinear axis, a slot in its aft portion extending along said axis perpendicular to and through said undersurface, the forward portion having a forward end and, spacedly aft thereform, a plurality of pairs of threaded bores, each bore of each said pairs being spaced opposite symmetrically to the other bore of the same pair, said pairs of bores being located at different axial distances from said forward end, whereby to permit mounting, on any selected pair of bores, a forwardly directed spring stop of the type having a pressure pad mounted on a shaft spring-biased axially in a casing having mounting lugs spaced evenly on opposite sides of said shaft axis at a distance corresponding to the spacing of one of said pairs of threaded bores.

* * * * *